US010134542B2

(12) United States Patent
Sato

(10) Patent No.: US 10,134,542 B2
(45) Date of Patent: Nov. 20, 2018

(54) TRIGGER SWITCH WITH LOCK MEMBER

(71) Applicant: NIDEC COPAL ELECTRONICS CORPORATION, Tokyo (JP)

(72) Inventor: Manabu Sato, Iruma (JP)

(73) Assignee: NIDEC COPAL ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 15/700,896

(22) Filed: Sep. 11, 2017

(65) Prior Publication Data

US 2017/0372855 A1 Dec. 28, 2017

Related U.S. Application Data

(63) Continuation of application No. PCT/JP2016/063245, filed on Apr. 27, 2016.

(30) Foreign Application Priority Data

May 22, 2015 (JP) ..... 2015-104589

(51) Int. Cl.
*H01H 13/08* (2006.01)
*H01H 13/14* (2006.01)
(Continued)

(52) U.S. Cl.
CPC ..... *H01H 13/14* (2013.01); *H01H 3/20* (2013.01); *H01H 9/06* (2013.01); *H01H 13/08* (2013.01);
(Continued)

(58) Field of Classification Search
CPC ..... H01H 13/00; H01H 13/08; H01H 3/20; H01H 9/06; H01H 2231/048; B25C 1/008
See application file for complete search history.

(56) References Cited

U.S. PATENT DOCUMENTS 7,476,821 B1 * 1/2009 Knuppel ..... H01H 3/20 200/332.2
8,198,560 B2 * 6/2012 Kimata ..... H01H 3/20 200/318.1
(Continued)

FOREIGN PATENT DOCUMENTS

CN 1897200 A 1/2007
CN 101027166 A 8/2007
(Continued)

OTHER PUBLICATIONS

International Search Report and Written Opinion (with partial English translation) dated Jun. 17, 2016 and dated Jun. 29, 2016 regarding International Application No. PCT/JP2016/063245 (11 pages).
(Continued)

*Primary Examiner* — Vanessa Girardi
(74) *Attorney, Agent, or Firm* — Harness, Dickey & Pierce, P.L.C.

(57) ABSTRACT

A lock member includes a fit portion, an inclined portion and a contacting portion. The fit portion is fitted with a projecting portion of a trigger to maintain an off-lock state. The inclined portion is brought into contact with a shaft of an unlock button and moves the lock member to release the off-lock state. The projecting portion is slidable on the contacting portion and maintains an on state.

3 Claims, 3 Drawing Sheets

(51) Int. Cl.
*H01H 9/06* (2006.01)
*H01H 3/20* (2006.01)
*B25C 1/00* (2006.01)

(52) U.S. Cl.
CPC ..... *B25C 1/008* (2013.01); *H01H 2231/048* (2013.01)

(56) References Cited

U.S. PATENT DOCUMENTS

| | | | | |
|---|---|---|---|---|
| 8,550,320 | B2 * | 10/2013 | Nakano | B25C 1/06 227/130 |
| 8,800,835 | B2 * | 8/2014 | Perron | B25C 1/008 173/170 |
| 2011/0308920 | A1 * | 12/2011 | Shi | B25F 5/00 200/43.17 |

FOREIGN PATENT DOCUMENTS

| | | | |
|---|---|---|---|
| JP | 5885723 | U | 6/1983 |
| JP | 5885724 | U | 6/1983 |
| JP | 2524664 | Y2 | 2/1997 |
| JP | 2549509 | Y2 | 9/1997 |
| JP | 2002-56735 | A | 2/2002 |
| JP | 2011-218521 | A | 11/2011 |

OTHER PUBLICATIONS

Chinese Office Action for Application No. 201680017034.9 dated Sep. 3, 2018 with English translation (13 pages).

* cited by examiner

TRIGGER SWITCH WITH LOCK MEMBER

CROSS-REFERENCE TO RELATED APPLICATIONS

This application is a continuation application of PCT Application No. PCT/JP2016/063245 filed on Apr. 27, 2016. This application claims the benefit and priority of Japanese Patent Application No. 2015-104589 filed on May 22, 2015, the entire contents of all of which are incorporated herein by reference.

BACKGROUND

1. Field of the Invention

Embodiments of the present invention described herein relate generally to a trigger switch to be applied, for example, to a power tool.

2. Description of the Related Art

Trigger switches of this kind are provided with a lock mechanism which locks the operation of the trigger as an operator in order to avoid the power of the tool from being carelessly turned on. The lock mechanism holds an off state of the trigger switch. When the lock mechanism is unlocked, the trigger is set to be operable to supply the power to the power tool (See, for example, JP 2524664 Y (Patent Literature 1) and JP 2549509 Y (Patent Literature 2)).

The lock mechanisms include a unlock button for releasing the lock. The unlock button is provided outside a switch body and the lock mechanism provided in inside the switch body can be released by operating the unlock button. The lock mechanism involves a great number of parts and is complicated in assembling. Further, the lock mechanism needs to be such a structure which does not malfunction due to dust or the like.

Embodiments of the present invention each provide a trigger switch involving a small number of parts, which can be easily assembled and can prevent malfunctioning.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A trigger switch comprising: a switch body; a switch mechanism provided in the switch body; a first operator provided to be insertable to or withdrawable from a first side surface of the switch body, which drives the switch mechanism; a first elastic member which urges the first operator in a first direction projecting from the switch body; a projecting portion provided on an end of the first operator, located in the switch body; a second operator provided to be insertable to or withdrawable from a second side surface adjacent to the first side surface of the switch body; a second elastic member which urges the second operator in a second direction projecting from the switch body; a holder provided inside the switch body and near the second side surface; a lock member provided to be movable along a direction orthogonal to the first and second directions; and a third elastic member which urges the lock member in a third direction projecting from the holder, wherein the lock member comprises an inclined portion contactable by the end of the second operator, located in the switch body, which moves the lock member into the holder when the second operator is pushed in a direction opposite to the second direction, and a fit portion fittable by the projecting portion of the first operator when the first operator and the second operator project to set the switch mechanism in an off state.

Embodiments of the present invention will be described below with reference to the accompanying drawings. Elements like or similar to those disclosed in the above embodiment are denoted by similar reference numbers.

Figure 1:
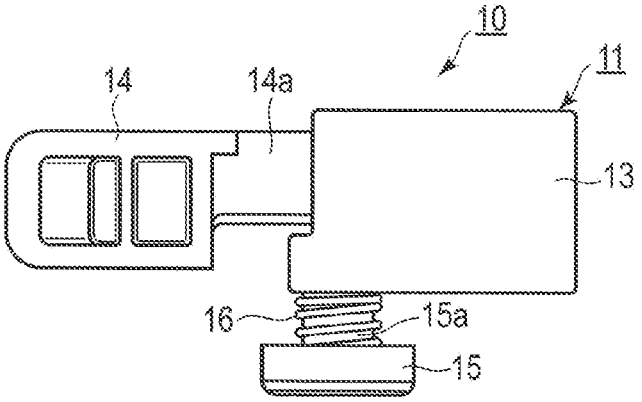
FIG. 1 is a top view of a trigger switch according to an embodiment.
Figure 2:
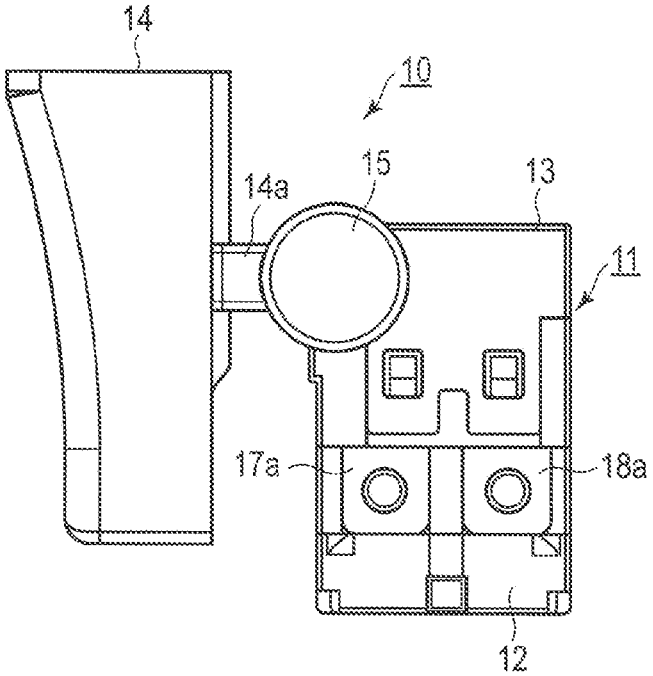
FIG. 2 is a side view of the trigger switch shown in FIG. 1.

As shown in FIGS. 1 and 2, a trigger switch 10 comprises a switch body 11, a trigger 14 as a first operator, and an unlock button 15 as a second operator, for releasing the lock on the trigger 14. The switch body 11 comprises a housing 12 and a cover 13 mounted to the housing 12.

The trigger 14 includes a shaft 14*a*. The shaft 14*a* is inserted in a first side surface of the switch body 11 and is provided to be insertable to or withdrawable from the first side surface.

The unlock button 15 includes a shaft 15*a*. As shown in FIG. 1, the shaft 15*a* is inserted to a second side surface orthogonally intersecting the first side surface of the switch body 11, to be insertable to or withdrawable from the second side surface. That is, the unlock button 15 is movable along a direction orthogonally intersecting a moving direction of the trigger 14. The unlock button 15 is urged with a spring 16 in a direction projecting from the switch body 11. That is, the spring 16 is provided around the shaft 15*a* between the unlock button 15 and the second side surface of the switch body 11. For example, grease (not shown) is applied on the circumference of the shaft 15*a* to block the gap between the shaft 15*a* and the second side surface. Thus, the entering of dust from the gap into the switch body 11 is prevented.

As shown in FIG. 2, on the second side surface of the switch body 11, terminals 17*a* and 18*a* electrically connected to first and second fixed contact pieces are arranged, which constitute a switch mechanism, as will be described later.

Figure 3:
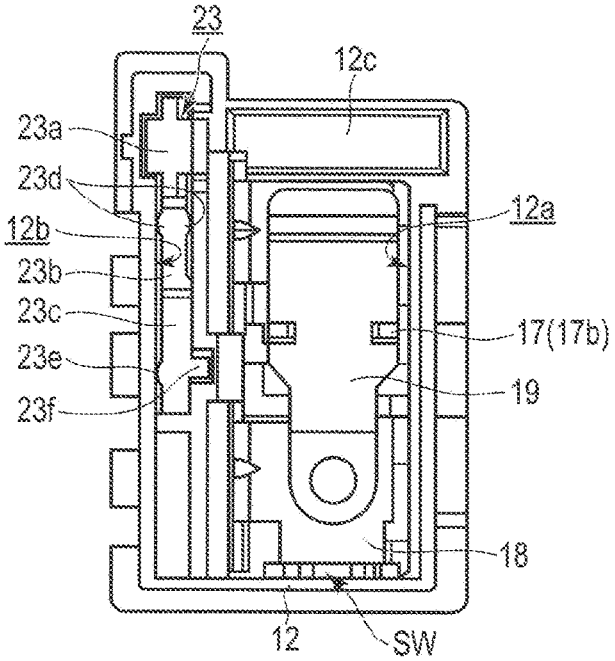
FIG. 3 is a partial top view of the trigger switch shown in FIG. 1.
Figure 4:
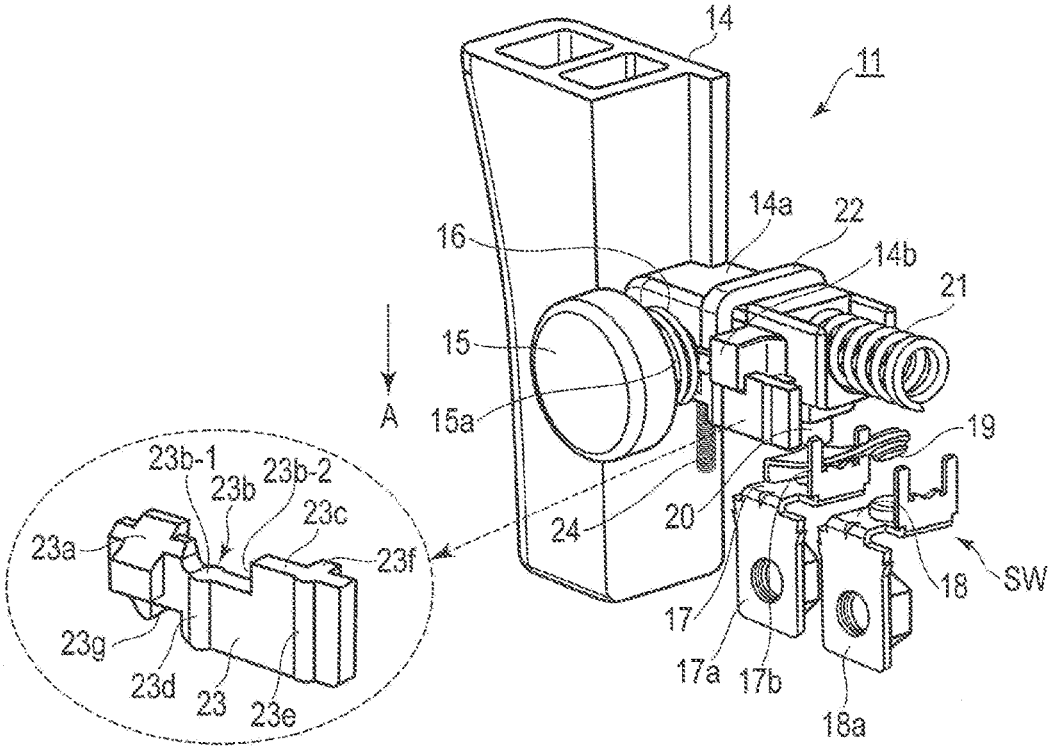
FIG. 4 is an exploded perspective view of the trigger switch shown in FIG. 1.

As shown in FIG. 3, the housing 12 includes, for example, first and second holders 12*a* and 12*b*. Inside the first holder 12*a*, the first fixed contact piece 17 (for example, common contact piece) and the second fixed contact piece 18 are provided, which constitute a switch mechanism SW. As shown in FIG. 4, the first fixed contact piece 17 and the second fixed contact piece 18 are arranged to be apart from each other at a predetermined interval along the moving direction of the trigger 14.

As shown in FIGS. 3 and 4, the first fixed contact piece 17 includes a stand portion 17*b*. A movable contact piece 19, which constitutes the switch mechanism SW, comprises a longitudinal substantially central portion which is rotatably supported by the stand portion 17*b*. The movable contact piece 19 constitutes a seesaw switch, for example, and on an upper surface of the movable contact piece 19, an end of a push rod 20 is slidably brought into contact. An other end of the push rod 20 is held in a recess (not shown) formed in the shaft 14*a* of the trigger 14. In the recess, a spring (not shown) is provided to press the push rod 20 against the upper surface of the movable contact piece 19.

The trigger 14 is urged with the spring 21 in the direction projecting from the switch body 11. That is, the spring 21 is provided between the end of the shaft 14*a* of the trigger 14 and the inner surface of the cover 13, for example.

A projecting portion 14*b* is formed on a side surface of a portion of the shaft 14*a* of the trigger 14, which is located in, for example, the cover 13. The projecting portion 14*b* is located above the second holder 12*b*. The shape of the projecting portion 14*b* is a rectangular parallelepiped, for example, and constitutes the lock mechanism together with a lock member 23, which will be described later.

On the shaft 14*a* of the trigger 14, a packing 22 is provided as a dustproof member. The packing 22 is formed from urethane rubber, for example, and is brought into contact with the circumference of the shaft 14*a*. The packing 22 is held in a groove portion 12*c* formed in the housing 12 and the cover 13 within the first side surface of the switch body 11. (Note that the groove portion of the cover 13 is not shown).

As shown in FIG. 3, the lock member 23 is held in the second holder 12*b* of the housing 12. The lock member 23 is movable inside the second holder 12*b* along the moving direction of the trigger 14 and a direction orthogonally intersecting the moving direction of the unlock button 15.

As shown in FIG. 4, the lock member 23 is urged with the spring 24 in the direction projecting from the second holder 12*b*. The spring 24 is provided between a bottom portion (not shown) of the second holder 12*b* and the recess 23*g* formed in the lock member 23.

As shown in FIGS. 3 and 4, the lock member 23 comprises an inclined portion 23*a*, a recessed fit portion 23*b*, a contacting portion 23*c*, a plurality of projections 23*d* and 23*e*, a guide portion 23*f* and a recess portion 23*g*. The inclined portion 23*a*, the fit portion 23*b* and the contacting portion 23*c* are arranged in order along a direction to which the trigger 14 moves.

The inclined portion 23*a* is formed in a position of the shaft 15*a* provided in the unlock button 15, which can be brought into contact with an inner end portion of the switch body 11. The inclined portion 23*a* is inclined to be higher as becoming apart further from the end of the shaft 15*a* provided in the unlock button 15. With this structure, if the unlock button 15 is pushed into the switch body 11 to press the end of the shaft 15*a* against the inclined portion 23*a*, the lock member 23 is moved into the second holder 12*b* (a direction indicated by arrow A) against the urging force of the spring 24.

The fit portion 23*b* is formed into a recessed shape, for example, so as to be fittable with the rectangular parallelepiped projecting portion 14*b* provided in the trigger 14 (the projecting portion 14*b* will be referred to as the projecting portion 14*b* of the trigger 14 hereinafter). That is, the fit portion 23*b* is arranged at a position fittable with the projecting portion 14*b* of the trigger 14 while the shaft 14*a* of the trigger 14 projecting from the switch body 11.

While the projecting portion 14*b* of the trigger 14 and the fit portion 23*b* are fit, a bottom surface 23*b*-1 of the fit portion 23*b* is brought into contact with a bottom surface of the projection portion 14*b*, which is on a side of the second holder 12*b*, by the urging force of the spring 24. In this state, the projecting position of the lock member 23 and the projection position of the trigger 14 are defined.

Moreover, while the projecting portion 14*b* of the trigger 14 fitting with the fit portion 23*b*, when the trigger 14 is pushed, the side surface opposite to the trigger 14 of the projecting portion 14*b* is brought into contact with the side surface 23*b*-2 opposite to the trigger 14 of the fit portion 23*b*. Thus, the trigger 14 is locked at the position where the switch mechanism SW in an off state (this will be called an off-lock position hereinafter).

The surface of the contacting portion 23*c* is flat, for example, and the height of the surface of the contacting portion 23*c* is set as high as or slightly lower than the highest position of the inclined portion 23*a*. When the unlock button 15 is pushed in and the lock member 23 is moved into the second holder 12*b*, the fitting state between the fit portion 23*b* and the projecting portion 14*b* of the trigger 14 is released to allow the projecting portion 14*b* of the trigger 14 to be movable above the contacting portion 23*c*.

Note that the projecting portion 14*b* of the trigger 14 is not limited to a rectangular parallelepiped shape, or the fit portion 23*b* is not limited to a recess shape, but the projecting portion 14*b* and the fit portion 23*b* may be of any shapes as long as they are in contact with each other by their surfaces.

Further, the surface of the contacting portion 23*c* is not limited to flat, as long as the contacting portion 23*c* is configured to be brought into contact with the projecting portion 14*b* of the trigger 14.

The plurality of projections 23*d* and 23*e* are formed on the side surface (outer surface) of the lock member 23 along the moving direction of the lock member 23. The projections 23*d* and 23*e* are formed into semi-cylindrical shape, for example, and distal ends of the projections 23*d* and 23*e* are brought into contact with the inner surface of the second holder 12*b*. Therefore, interfacial friction between the lock member 23 and the second holder 12*b* can be reduced, thereby making it possible to move the lock member 23 smoothly within the second holder 12*b*.

Moreover, with the projections 23*d* and 23*e* of the lock member 23, a gap equivalent to the thickness of the projections 23*d* and 23*e* is formed between the inner surface of the second holder 12*b* and the lock member 23. Therefore, even in case where dust enters the second holder 12*b*, the dust can be dropped into the bottom of the second holder 12*b* through the gap.

Note that the projections 23*d* and 23*e* are provided on the lock member 23, but the structure is not limited to this. The side surface of the lock member 23 may be formed flat and a plurality of projections may be formed in the second holder 12*b*.

The guide portion 23*f* is formed on the side surface of the lock member 23 along the moving direction of the lock member. The guide portion 23*f* is formed into a rectangular parallelepiped shape, for example, and is slidably fit in the groove formed in the inner surface of the second holder 12*b*. With the guide portion 23*f*, it is possible to prevent the lock member 23 from inclining within the second holder 12*b*. Thus, the lock member 23 can be smoothly moved within the second holder 12*b*.

Note that the guide portion 23*f* is formed on the lock member 23 and the groove is formed in the second holder 12*b*, but the structure is not limited to this. The guide portion may be provided on the second holder 12*b* and the groove may be formed in the lock member 23.

(Action)

The operation of the trigger switch 10 having the above-described structure will be described with reference to FIGS. 1 to 6.

As shown in FIGS. 1 to 4, in the state where the trigger 14 projects out from the switch body 11, the movable contact piece 19, which constitutes the switch mechanism SW is in the off state in which it is spaced from the second fixed contact piece 18. In this state, when the unlock button 15 projects from the switch body 11, the inclined portion 23*a*, the fit portion 23*b* and the contacting portion 23*c* of the lock member 23 project from the second holder 12*b* by the spring 24, and the fit portion 23*b* is fit with the projecting portion 14*b* of the trigger 14. Therefore, the trigger 14 is held in an off-lock position where it cannot be pushed in the switch body 11.

In the off-lock position, when the unlock button 15 is pushed in, the shaft 15*a* of the unlock button 15 is brought into contact with the inclined portion 23*a* of the lock member 23. If the unlock button 15 is further pushed in from this state, the lock member 23 is moved into the second holder 12*b* (the direction indicated by arrow A shown in FIG. 4) against the urging force of the spring 24. Thus, the fitting state between the fit portion 23*b* of the lock member 23 and the projecting portion 14*b* of the trigger 14 is released.

Figure 5:
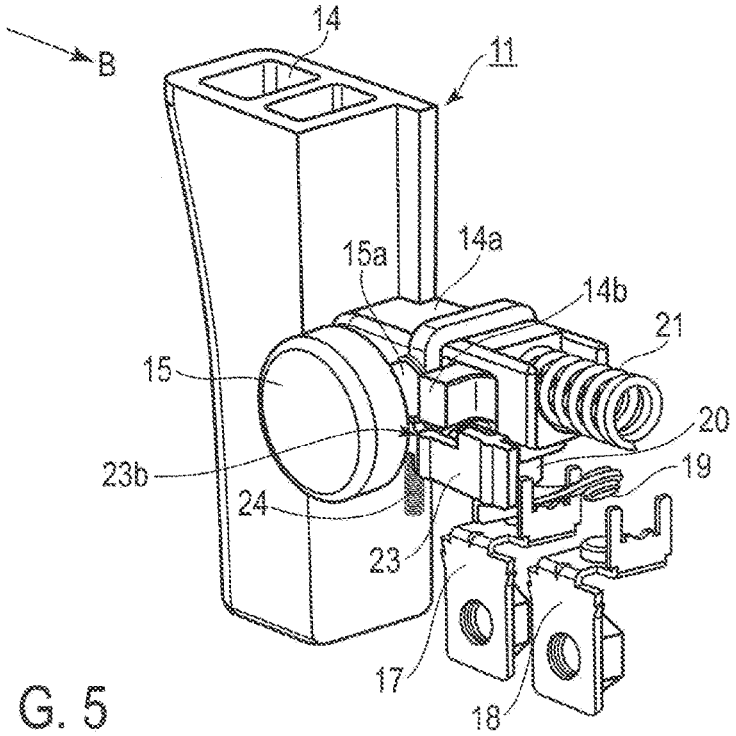
FIG. 5 is an exploded perspective view showing operation of the trigger switch.

FIG. 5 shows a state where the fitting state between of the fit portion 23*b* of the lock member 23 and the projecting portion 14*b* of the trigger 14 is released. In this state, if the trigger 14 is pushed against the urging force of the spring 21 in the direction indicated by arrow B in the figure, the push rod 20 slides on the movable contact piece 19 with the movement of the trigger 14. When the push rod 20 passes the stand portion 17*b* of the first fixed contact piece 17, the movable contact piece 19 rotates.

Figure 6:
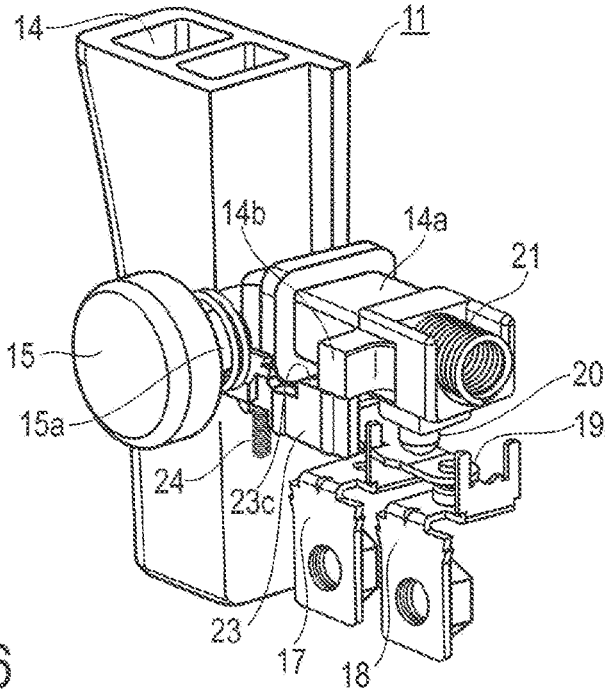
FIG. 6 is an exploded perspective view showing an operation state different from that of FIG. 5.

FIG. 6 shows a state where the movable contact piece 19 rotates. Thus, when the movable contact piece 19 rotates to be brought into contact with the second fixed contact piece 18, the switch mechanism SW is set in an on state.

When the switch mechanism SW is in the on state, the projecting portion 14*b* of the trigger 14 is located on the contacting portion 23*c* of the lock member 23. Therefore, even while the pressing force on the unlock button 15 is released, the lock member 23 is pressed down by the projecting portion 14*b* of the trigger 14 so as to be pushed and held in the second holder 12*b*.

While the switch mechanism SW is in the on state, when the pressing force on the trigger 14 is released, the trigger 14 is moved with the urging force of the spring 21 in the direction projecting from the switch body 11. Accordingly, the projecting portion 14*b* of the trigger 14 slides on the contacting portion 23*c* of the lock member 23. When the trigger 14 returns to the position shown in FIG. 5, the switch mechanism SW is set in the off state. Further, the lock member 23 is moved in the direction projecting from the second holder 12*b* with the urging force of the spring 24. Therefore, as shown in FIG. 4, the fit portion 23*b* and the projecting portion 14*b* of the trigger 14 are fit with each other to restore the off-lock state.

The switch mechanism SW is described above by presenting an example in which the electric power is turned on/off, but the present invention is not limited to this. It is also applicable to a trigger switch with speed control, comprising a built-in electronic circuit which can control the number of revolutions of the motor.

(Effect)

According to the embodiment, the lock mechanism comprises the unlock button 15, the spring 16, the lock member 23, the spring 24 and the projecting portion 14*b* of the trigger 14 fitted with the fit portion 23*b* of the lock member 23. Thus, the lock mechanism can be formed from a small number of parts. Further, in the lock mechanism, the lock member 23 and the spring 24 can be assembled by dropping them into the second holder 12*b*, and while in this state, placing the trigger 14 on the housing 12 and mounting the cover 13 thereon. Thus, it can be easily assembled.

Furthermore, for example, in the off-lock state where the projecting portion 14*b* of the trigger 14 is fitted with the fit portion 23*b* of the lock member 23, when the trigger 14 is pushed, the side surface of the projecting portion 14*b*, which is opposite to the trigger 14 is brought into contact with the side surface 23*b*-2 of the fit portion 23*b*, which is opposite to the trigger 14. That is, the projecting portion 14*b* and the fit portion 23*b* are in interfacial contact with each other. Therefore, sufficient rigidity can be obtained, making it possible to reliably hold the off-lock state.

Moreover, the lock member 23 is of such a structure where it comprises the inclined portion 23*a*, and in order to release the off-lock state, the unlock button 15 is pushed, thereby to bring the shaft 15*a* of the unlock button 15 into contact with the inclined portion 23*a* and depress the lock member 23. Therefore, when operating to release the lock, excessive force is not applied to the unlock button 15 or the lock member 23. Therefore, damage on these parts can be prevented, thereby improving the reliability of the trigger switch.

Furthermore, the lock member 23 comprises a plurality of projections 23*d* and 23*e* and a gap created between the inner surface of the second holder 12*b* and the lock member 23, which is equivalent to the thickness of the projections 23*d* and 23*e*. With this structure, even in case where dust enters the second holder 12*b*, the dust can be dropped into the bottom of the second holder 12*b* through the gap. Thus, the malfunction of the lock member 23 can be prevented, thereby improving the reliability of the trigger switch.

Moreover, in the on state where the trigger 14 is pushed in, the contacting portion 23*c* of the lock member 23 is brought into contact with the projecting portion 14*b* of the trigger 14 to push and hold the lock member 23 in the second holder 12*b*. Therefore, if the pressing force on the unlock button 15 is released, the on state can be maintained. Further, when the pressing force on the trigger 14 is released from the on state, the lock member 23 projects out from the second holder 12*b* by the urging force of the spring 24 while the projecting portion 14*b* is already moved to the position of the fit portion 23*b*, and thus the projecting portion 14*b* is fitted with the fit portion 23*b*. Thus, the off-lock state can be restored automatically, maintaining high operability.

The present invention is not limited to the embodiments described above but the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

What is claimed is:

1. A trigger switch comprising:

a switch body;

a switch mechanism provided in the switch body;

a first operator provided to be insertable to or withdrawable from a first side surface of the switch body, which drives the switch mechanism;

a first elastic member which urges the first operator in a first direction projecting from the switch body;

a projecting portion provided on an end of the first operator, located in the switch body;

a second operator provided to be insertable to or withdrawable from a second side surface adjacent to the first side surface of the switch body;

a second elastic member which urges the second operator in a second direction projecting from the switch body;

a holder provided inside the switch body and near the second side surface;

a lock member provided to be movable along a direction orthogonal to the first and second directions; and a third elastic member which urges the lock member in a third direction projecting from the holder, wherein the lock member comprises an inclined portion contactable by the end of the second operator, located in the switch body, which moves the lock member into the holder when the second operator is pushed in a direction opposite to the second direction, and a fit portion fittable by the projecting portion of the first operator when the first operator and the second operator project to set the switch mechanism in an off state.

2. The trigger switch of claim 1, wherein the lock member comprises a contacting portion to be brought into contact with the projecting portion when the first operator is pushed in a direction opposite to the first direction and the switch mechanism is in the on state, and the lock member is pushed and held in the holder.

3. The trigger switch of claim 1, further comprising a plurality of third projections provided on one of an outer surface of the lock member and the inner surface of the holder, so as to be brought into contact with one of the inner surface of the holder and the outer surface of the lock member.

* * * * *